US005780144A

United States Patent [19]

Bradley

[11] Patent Number: 5,780,144

[45] Date of Patent: Jul. 14, 1998

[54] PLANAR DRAINAGE AND IMPACT PROTECTION MATERIAL

[75] Inventor: Anthony S. Bradley, Valparaiso, Fla.

[73] Assignee: Bradley Industrial Textiles, Inc., Valparaiso, Fla.

[21] Appl. No.: 700,057

[22] Filed: Aug. 20, 1996

Related U.S. Application Data

[63] Continuation of Ser. No. 334,407, Nov. 4, 1994, abandoned.

[51] Int. Cl.[6] ..... E02B 11/00

[52] U.S. Cl. ..... 428/217; 428/212; 428/219; 442/383; 405/36; 405/50

[58] Field of Search ..... 428/212, 213, 428/217, 219; 442/383; 405/36, 50

[56] References Cited

U.S. PATENT DOCUMENTS

| | | | |
|---|---|---|---|
| Re. 33,023 | 8/1989 | Hiers . | |
| 3,260,640 | 7/1966 | Owen . | |
| 4,041,203 | 8/1977 | Brock et al. . | |
| 4,153,750 | 5/1979 | Piquilloud . | |
| 4,196,245 | 4/1980 | Kitson et al. | 428/198 |
| 4,205,113 | 5/1980 | Hermansson et al. . | |
| 4,398,451 | 8/1983 | Werthmann | 98/50 |
| 4,469,740 | 9/1984 | Bailly . | |
| 4,563,387 | 1/1986 | Takagi et al. . | |
| 4,780,359 | 10/1988 | Trask et al. . | |
| 4,840,515 | 6/1989 | Freese . | |
| 4,931,358 | 6/1990 | Wahl et al. . | |
| 4,996,102 | 2/1991 | Kyutoku et al. . | |
| 5,246,760 | 9/1993 | Krickl . | |
| 5,298,319 | 3/1994 | Donahue et al. . | |
| 5,372,876 | 12/1994 | Johnson et al. | 428/233 |

*Primary Examiner*—James J. Bell
*Attorney, Agent, or Firm*—Dority & Manning

[57] ABSTRACT

A composite sheet material for use as a planar drain and a protection board. The sheet material has a multi-layer construction formed into a composite by needling. The multi-layer construction preferably has a layer of a soft nonwoven fabric material sandwiched between outer layers of a stiffened fabric material. The composite material may be configured into relatively narrow longitudinal strips for use as a wicking drain. Such longitudinal strips may often have a width of approximately three (3) inches or less in exemplary constructions.

26 Claims, 2 Drawing Sheets

PLANAR DRAINAGE AND IMPACT PROTECTION MATERIAL

This is a continuation of application Ser. No. 08/334,407, filed Nov. 4, 1994, which was abandoned upon the filing hereof.

BACKGROUND OF THE INVENTION

The present invention relates to a composite material suitable for use as a planar drain and a protection board.

Drains constructed in the form of a sheet are utilized in various applications to facilitate removal of excess water. For example, these drains may be permanently built into buildings and other such structures during the construction phase. One application in which these drains are frequently utilized is adjacent subterranean walls to relieve hydrostatic pressure which may otherwise be built up.

Generally, drains of this type are configured having a "backbone" material of corrugated plastic. A sheet of filter fabric is attached to the plastic backbone. The filter fabric allows moisture to pass through to the plastic backbone where it may flow in a generally planar manner. One exemplary drain of this type is described in U.S. Pat. No. 4,840,515, issued to Freese.

Sheet-like materials are also employed in various applications as a "protection board." For example, it is often desirable to situate a protection board in juxtaposition to an elastic membrane subject to puncture on impact. For example, protection boards may be utilized behind vinyl liners in swimming pools. Additionally, protection boards may be placed either in front of or behind waterproofing membranes which are used in the basements of buildings to inhibit water seepage. The protection board functions to absorb some of the shock imparted by an impact, thus lessening the likelihood that the associated membrane will be punctured.

While a sheetlike drain as described above may function as a protection board, a lower cost material not having significant drainage capability has generally been used unless a large amount of water is expected. One such protection board has been constructed having two layers of nonwoven fabric material which were attached together by needling. One of the layers of this material was stiffened by impregnating the material with a water-based resin. The second layer was a soft material constructed of continuous filament fibers.

In use, this prior art material was generally placed such that any expected impact force would contact the stiffened layer first. The rigidity of the stiffened material would spread the energy of the impact over a larger area. The soft material under this larger area would then at least partially absorb the energy of the impact.

The stiffened material of the first layer was configured to have a weight falling within a range of approximately 140 grams per square yard to 250 grams per square yard. In order to provide a sufficient quantity of the soft material to facilitate shock absorbency, the second layer was configured having a weight of approximately 120 grams per square yard. At this weight, the second layer had a thickness of approximately 60 mils.

While this construction functioned reasonably well as a protection board, it failed to provide a sufficient degree of susceptibility to water flow to be considered an effective planar drain.

SUMMARY OF THE INVENTION

The present invention recognizes and addresses the foregoing disadvantages, and others, of prior art constructions and methods. Accordingly, it is an object of the present invention to provide an improved composite material.

It is another object of the present invention to provide an improved composite material constructed of two layers.

It is another object of the present invention to provide an improved composite material constructed of three layers.

It is a further object of the present invention to provide an improved composite material which effectively functions as a planar drain and a protection board at relatively low cost.

It is a further object of the present invention to provide an improved composite material which may be utilized as a strip wicking drain.

Some of these objects are achieved by a composite sheet material having a first layer of a soft nonwoven fabric material. The soft nonwoven fabric material is preferably constructed of continuous filament fibers. Preferably, the soft nonwoven fabric material has a weight of at least substantially 200 grams per square yard and a thickness of at least 75 mils. The continuous filament fibers preferably have a size falling in a range of approximately 1.5 to 10 denier.

A second layer of a stiffened nonwoven fabric material is attached to a first planar side of the first layer. A third layer of the stiffened fabric material is attached to a second planar side of the first layer opposite the first planar side. The stiffened fabric material is configured to have predetermined properties of rigidity.

In an exemplary construction, the stiffened fabric material comprises a nonwoven fabric material impregnated with a stiffening binder. Stiffened materials produced by calendering or heat bonding of a preferably nonwoven material may also be utilized. The stiffened material is preferably constructed having a weight falling within a range of substantially 140 grams per square yard to 250 grams per square yard. The stiffened layers are preferably attached to the first layer by needling.

Other objects are achieved by a wicking drain for use in removing moisture present in an area, such as in the soil. The wicking drain comprises a longitudinal strip of a composite material constructed in accordance with the invention. Preferably, such a composite material is configured as a three layer material having a first layer of a soft nonwoven fabric material sandwiched between layers of a stiffened fabric material. The layers of stiffened fabric material provide rigidity to facilitate placement of the wicking drain, while the inner layer provides a wicking channel through which the accumulated liquid may flow. The longitudinal strip may often have a width of approximately three (3) inches or less in exemplary constructions.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
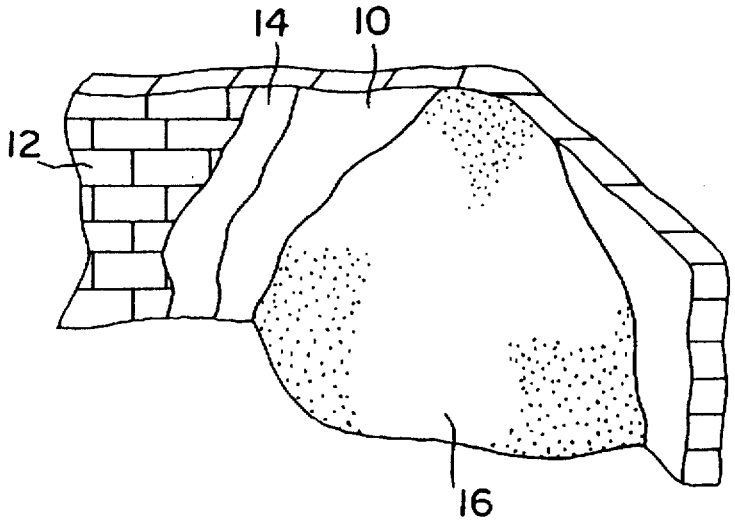
FIG. 1 illustrates one application in which a composite sheet material constructed in accordance with present invention may be utilized.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

Referring now to FIG. 1, a typical application is illustrated in which a composite sheet material of the invention may be utilized. Specifically, a composite sheet material of the invention, indicated generally at 10, is shown serving as a planar drain and a protection board along a basement wall 12, which may conventionally be constructed of brick or the like. In this case, material 10 is situated in front of a waterproofing membrane 14 which has been applied to wall 12. Material 10 may be maintained in this position by appropriate mastic, adhesive or the like. In some applications, dirt may be backfilled against material 10, as indicated at 16.

Material 10 thus functions to protect membrane 14 from an impact which may otherwise cause it to puncture. For example, the heavy equipment utilized to provide backfill dirt 16 may occasionally bump into material 10. In the absence of material 10, the heavy equipment would bump directly into membrane 14. In addition to serving as a protection board, material 10 functions as a planar drain. Specifically, water captured by material 10 will tend to flow in the plane thereof. In this case, such water will tend to flow vertically down.

Figure 2:
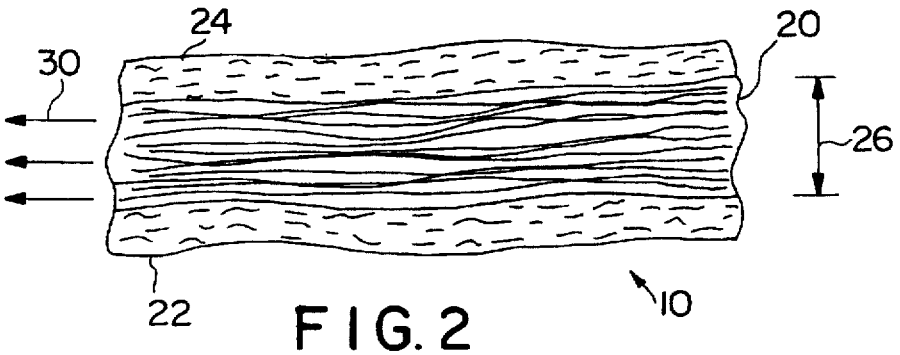
FIG. 2 is a cross sectional view of one embodiment of a composite sheet material constructed in accordance with the invention.

FIG. 2 illustrates in cross section one preferred construction of material 10. As shown, material 10 includes an inner layer 20 sandwiched between respective outer layers 22 and 24. Preferably, inner layer 20 is formed of a soft nonwoven fabric material, whereas outer layers 22 and 24 are formed of stiffened fabric material. The respective materials of layers 20, 22, and 24 are attached together to form a composite having the desired combination of features.

While material 10 is shown constructed as a three-layer material, it should be appreciated that two layers may be sufficient in many applications. Such a two-layer material would generally be similar to material 10, but without one of layers 22 and 24. A three-layer material may often be preferred, however, due to the well-defined planar drain formed in layer 20 by the sandwich construction.

Particularly in the case of a two-layer material, the weight of layer 20 is preferably at least 200 grams per square yard. In exemplary constructions, the fibers forming the material of layer 20 preferably have a size falling in a range of approximately 1.5 to 10 denier. In an exemplary construction, this fiber has an average size of approximately 4.5 denier. Furthermore, the thickness of layer 20, as indicated by arrow 26, is preferably at least 75 mils.

Figure 3:
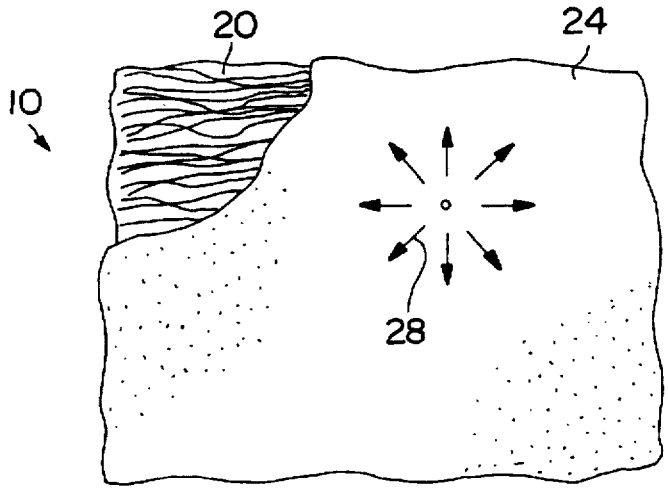
FIG. 3 is a plan view of a composite sheet material such as that shown in FIG. 1 in which a portion of the top layer is illustrated as being cut away.

Referring now also to FIG. 3, the material of layer 20 is preferably constructed substantially entirely of continuous filament fibers. Continuous filament fibers are often preferred because such will generally provide better permeability and better water flow than staple fibers. Staple fibers may occasionally be preferred for other reasons, however, such as cost.

The material forming layers 22 and 24 is preferably a nonwoven or spun-bonded material. The fibers of this material may be either continuous filament fibers or staple fibers, as desired. Preferably, the weight of the material forming layers 22 and 24 falls within a range of substantially 140 grams per square yard to 250 grams per square yard.

Layers 22 and 24 are each preferably processed to have predetermined properties of rigidity. A number of techniques may be utilized to achieve such rigidity. In some exemplary constructions, such rigidity may be achieved by impregnating a suitable fabric material with an appropriate binder. A suitable binder may be a water-based binder, such as a latex binder. Alternatively, fabrics may be utilized which have been processed by calendering or heat bonding in order to provide the desired degree of rigidity.

Due to the construction of each stiffened layer, such as layers 22 and 24 of material 10, a composite material of the invention also exhibits predetermined properties of rigidity. In addition to making material 10 relatively easy to manipulate, this rigidity functions to spread out the energy imparted by an impact. For example, such an impact is shown occurring in FIG. 3 at the dot surrounded by arrows. The arrows, such as arrow 28, indicate transmission of the energy away from the point of impact. As a result, the force of the impact is more easily absorbed by the soft material of layer 20.

As described above, a material of the invention, such as material 10, is further constructed to have a predetermined susceptibility to fluid flow through layer 20. Referring again to FIG. 2, layer 20 is configured so that fluid may flow in the plane between layers 22 and 24. For example, water may flow through layer 20 in the direction indicated by arrows 30. This susceptibility to fluid flow is achieved through the use of continuous filament fibers having the described weight. Layers of less weight, such as that utilized in the prior art, were found particularly in a two-layer material to have significantly less fluid flow. Additionally, the greater weight of material in layer 20 allows more energy to be absorbed from an impact.

Figure 4:
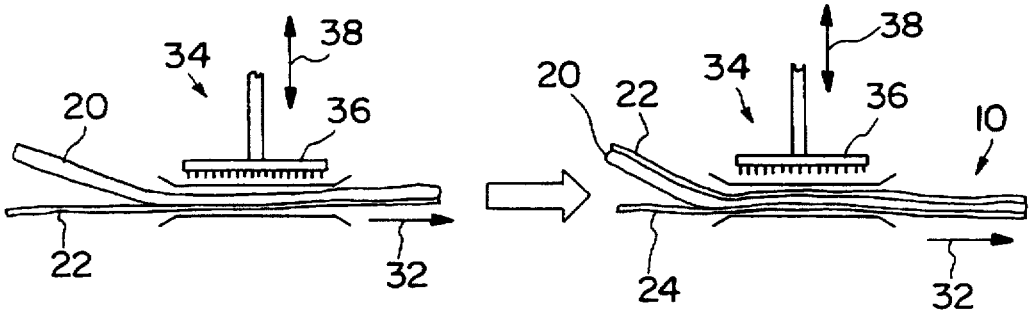
FIG. 4 diagrammatically illustrates the manner in which a composite sheet material such as that shown in FIG. 1 may be constructed.

A process by which material 10 may be manufactured is illustrated in FIG. 4. In the left rendering of FIG. 4, layer 20 is shown being attached to layer 22. As shown, layers 20 and 22 are moved, as indicated by arrow 32, through a needle loom generally indicated at 34. Needle loom 34 includes a needle board 36 having thereon a plurality of depending needles. Needle board 36 is reciprocated, as shown by arrow 38, such that its needles pass through layer 20 into layer 22. As a result, fibers of layer 20 are forced into layer 22, thus attaching the two layers together.

After layers 20 and 22 are attached, the combination is again passed through needle loom 34 to attach layer 24. Specifically, as shown in the right rendering of FIG. 4, the combination of layers 20 and 22 is inverted such that the unattached side of layer 20 will be proximate layer 24. Reciprocation of needle board 36 in this case causes the depending needles to pass through layer 22 and into layer 20. The needles then pass into layer 24, thus forcing fibers of layer 20 into layer 24. As a result, the overall composite material 10 is formed. It should be appreciated that various known needling methods could be utilized, including double sided needling, instead of inverting the materials as set forth above.

In addition to effecting attachment of the various layers, the needling process provides another significant advantage to composite material 10. Specifically, the needles of needle board 36 produce small holes in layers 22 and 24. These holes give layers 22 and 24 a desirable degree of permeability to fluid flow. For example, these holes permit water to pass into layer 20, where it may flow as shown by arrows 30. Similarly, these holes permit air to pass through layers 22 and 24, thus imparting material 10 with additional qualities of breathability. The stiffened layer of a two-layer material would also preferably have these small holes.

Figure 5A:
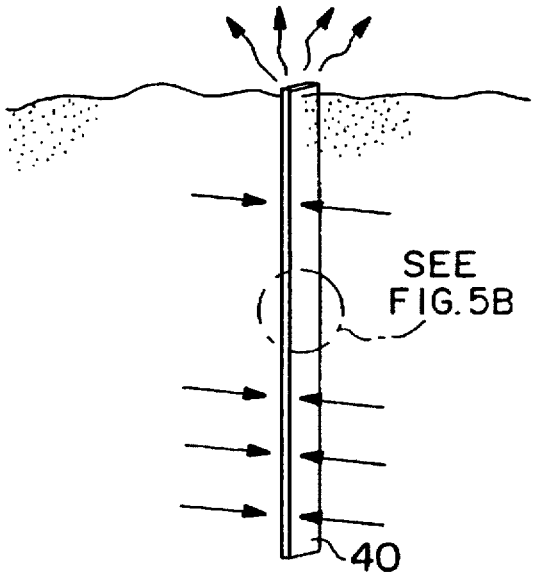
FIG. 5 illustrates a wicking drain constructed in accordance with the present invention.
Figure 5B:
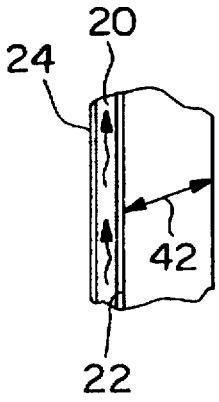

FIG. 5 illustrates another important application of composite material of the invention, such as material 10. In this case, composite material 10 has been cut into a longitudinal strip 40 for use as a wicking drain. Strip 40 has a width as indicated by arrow 42. Often, it will be desirable for this width to be three (3) inches or less.

The rigidity properties contributed by layers 22 and 24 allows strip 40 to be easily manipulated. Specifically, layers 22 and 24 offer less elongation than the material of layer 20, thus allowing strip 40 to be pushed down through the soil. The soft material of inner layer 20 is thus kept from necking or elongating. This construction is believed to offer water channeling characteristics comparable to present wick drains at lower expense.

The susceptibility of layer 20 to fluid flow functions in this case as a wick to remove moisture in the soil. This wicking action absorbs water into strip 40, where it wicks up to the surface of the soil. The water is then evaporated into the ambient atmosphere. As a result, damp soil may be strengthened.

In addition to the applications specifically illustrated herein, it should be appreciated that a composite material of the present invention may have utility in a variety of other applications. For example, a composite material of the invention may be utilized as a runner on carpets, floors and furniture. The soft material provides air flow in such applications, thus lessening moisture build-up which may be a problem with traditional protection mats.

Other modifications and variations to the present invention may also be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only and is not intended to be limitative of the invention so further described in such appended claims.

What is claimed is:

1. A composite material comprising:

a first layer of a soft nonwoven fabric material having a thickness and a planar weight sufficient to facilitate flow of a fluid along a plane of said first layer:

a second layer of a stiffened fabric material attached to a first planar side of said first layer, said stiffened fabric material being rigid relative to said first layer;

a third layer of said stiffened fabric material, rigid relative to said first layer, attached to a second planar side of said first layer opposite said first planar side; and, said layers being arranged such that said composite material has a structure defined by outer layers of said stiffened fabric material with said soft nonwoven fabric material sandwiched therebetween such that said composite material exhibits a degree of rigidity greater than said soft nonwoven fabric material and wherein fluid passing into said soft nonwoven fabric material can flow in said plane.

2. A composite material as set forth in claim 1, wherein said soft nonwoven fabric material is constructed substantially entirely of continuous filament fibers.

3. A composite material as set forth in claim 2, wherein said soft nonwoven fabric material has a weight of at least substantially 200 grams per square yard.

4. A composite material as set forth in 3, wherein said soft nonwoven fabric material has a thickness of at least 75 mils.

5. A composite material as set forth in claim 3, wherein said continuous filament fibers have a size falling in a range of approximately 1.5 to 10 denier.

6. A composite material as set forth in claim 1, wherein said stiffened fabric material comprises a nonwoven material impregnated with a stiffening binder.

7. A composite material as set forth in claim 1, wherein said stiffened fabric material comprises a calendered nonwoven fabric material.

8. A composite material as set forth in claim 1, wherein said stiffened fabric material comprises a heat-bonded nonwoven fabric material.

9. A composite material as set forth in claim 1, wherein said stiffened fabric material has a weight falling within a range of substantially 140 grams per square yard to 250 grams per square yard.

10. A composite material as set forth in claim 1, wherein said second layer and said third layer are attached to said first layer by needling.

11. A composite material having predetermined properties of rigidity and susceptibility to fluid flow, said composite material comprising:

a plurality of planar layers situated contiguous to one another and attached together, said plurality of planar layer including the following:

(a) at least one planar layer of a stiffened fabric material; and (b) a planar layer of a soft nonwoven fabric material having a rigidity less than a rigidity of said stiffened fabric material, said soft nonwoven fabric material constructed substantially entirely of continuous filament fibers and having a weight of at least substantially 200 grams per square yard.

12. A composite material as set forth in claim 11, configured into relatively narrow longitudinal strips for use as a wicking drain.

13. A composite material as set forth in claim 11, wherein said soft nonwoven fabric material has a thickness of at least 75 mils.

14. A composite material as set forth in claim 13, wherein said continuous filament fibers have a size falling in a range of approximately 1.5 to 10 denier.

15. A composite material as set forth in claim 11, wherein said stiffened fabric material comprises a nonwoven material impregnated with a stiffening binder.

16. A composite material as set forth in claim 11, wherein said stiffened fabric material comprises a calendered nonwoven fabric material.

17. A composite material as set forth in claim 11, wherein said stiffened fabric material comprises a heat-bonded nonwoven fabric material.

18. A composite material as set forth in claim 11, wherein said stiffened fabric material has a weight falling within a range of substantially 140 grams per square yard to 250 grams per square yard.

19. A composite material as set forth in claim 11, comprising first and second planar layers of said stiffened fabric material having said planar layer of said soft nonwoven material sandwiched therebetween.

20. A composite material as set forth in claim 11, wherein said plurality of contiguous layers are attached together by needling.

21. A wicking drain for use in removing moisture present in an area, said wicking drain comprising:

a longitudinal strip of a composite material, said composite material constructed having a plurality of planar layers situated contiguous to one another and attached together, said plurality of planar layers including the following:

(a) a first layer of a soft nonwoven fabric material, said soft nonwoven fabric material having a thickness and a planar weight sufficient to facilitate flow of a fluid along a plane thereof;

(b) a second layer of a stiffened fabric material attached to a first planar side of said first layer, said stiffened fabric material being rigid relative to said first layer; and (c) a third layer of said stiffened fabric material, rigid relative to said first layer, attached to a second planar side of said first layer, wherein said second and third layers provide rigidity to facilitate placement of the wicking drain and said first layer provides a wicking channel through which accumulated liquid may flow.

22. A wicking drain as set forth in claim 21, wherein said soft nonwoven fabric material is constructed substantially entirely of continuous filament fibers.

23. A wicking drain as set forth in claim 22, wherein said continuous filament fibers have a size falling in a range of approximately 1.5 to 10 denier.

24. A wicking drain as set forth in claim 22, wherein said soft nonwoven fabric material has a weight of at least substantially 200 grams per square yard.

25. A wicking drain as set forth in 22, wherein said soft nonwoven fabric material has a thickness of at least 75 mils.

26. A wicking drain as set forth in claim 21, wherein said longitudinal strip has a width of no greater than approximately three (3) inches.

* * * * *